United States Patent [19]

Liu

[11] Patent Number: 5,044,469

[45] Date of Patent: Sep. 3, 1991

[54] PORTABLE AUTOMOBILE ENGINE OIL SUCTION PUMP

[76] Inventor: Chen C. Liu, No. 9, Lane 119, Sec. 3, Ho Ping East Road, Taipei, Taiwan

[21] Appl. No.: 551,805

[22] Filed: Jul. 12, 1990

[51] Int. Cl.[5] ..... F16N 33/00

[52] U.S. Cl. ..... 184/1.5; 184/108; 417/410; 418/170

[58] Field of Search ..... 184/108, 1.5, 6.4, 6.28, 184/26; 340/686, 540, 568; 417/410, 372; 418/170; 200/61.2, 61.4, 61.42

[56] References Cited

U.S. PATENT DOCUMENTS

| | | | |
|---|---|---|---|
| 2,482,713 | 9/1949 | Jones | 418/170 |
| 2,635,550 | 4/1953 | Granberg | 184/1.5 |
| 3,048,119 | 8/1962 | Tydeman | 417/372 |
| 3,576,379 | 4/1971 | Parise | 417/410 |
| 3,679,334 | 7/1972 | Keldrauk | 418/170 |

*Primary Examiner*—James C. Yeung
*Assistant Examiner*—Alan B. Cariaso
*Attorney, Agent, or Firm*—Bacon & Thomas

[57] ABSTRACT

This invention aims at providing a portable type of automobile engine oil suction pump which features a simple construction and a luminous indication lamp to warn its users of the exhaustion of the engine oil. This invention provides the improved structure of a portable type of automobile engine oil suction pump. Its main features are: an inner gear set comprising an inner ring gear and a pinion gear in the interior of two circular disks; and, an eccentric, convex, crescent-shaped block having an inner concave edge in touch with the pinion, and located eccentric to the ring gear with its convex side jointly set with the pinion to form an outer peripheral shape so as to enable one side of the inner ring gear to be engaged by the pinion, and the other side to keep in touch with the convex face of the eccentric crescent block, so as to allow the inner pinion to directly join with the revolving shaft of the motor to cause the ring gear to rotate.

3 Claims, 4 Drawing Sheets

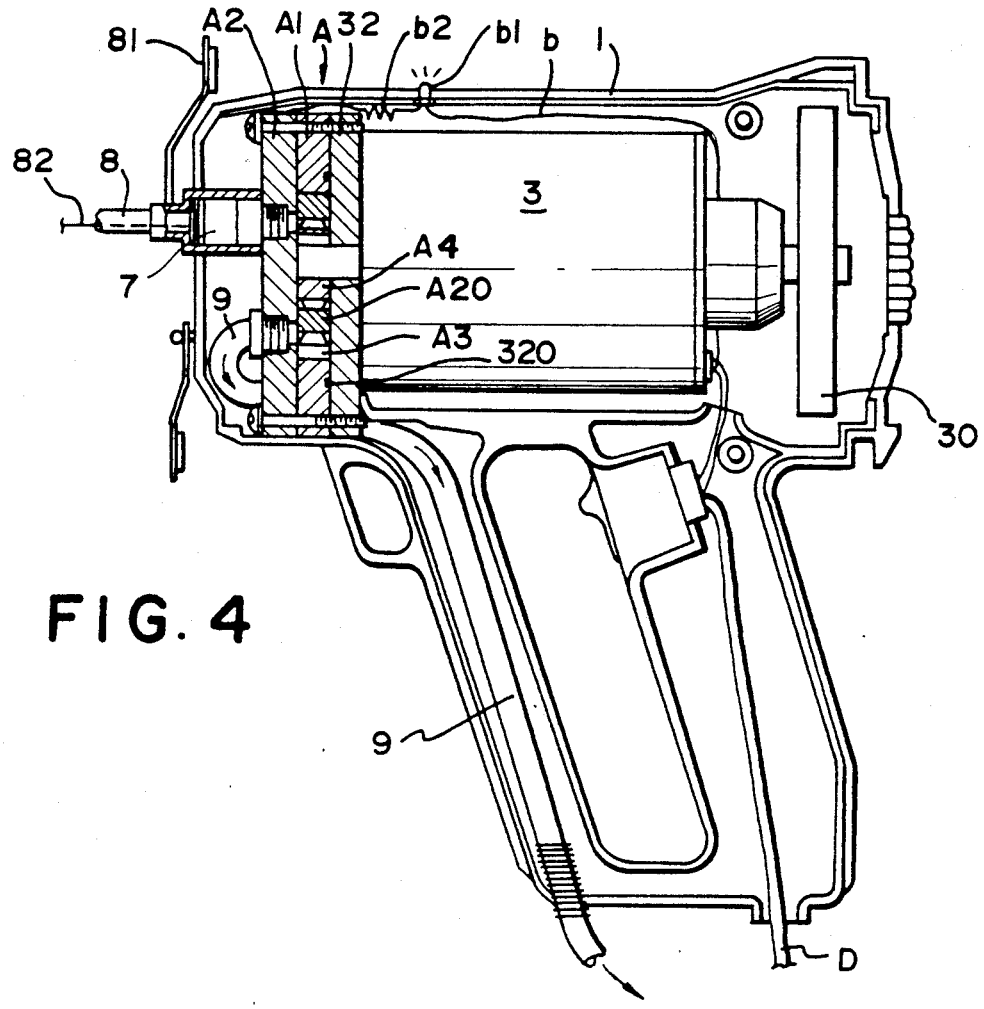
FIG. 4
FIG. 5
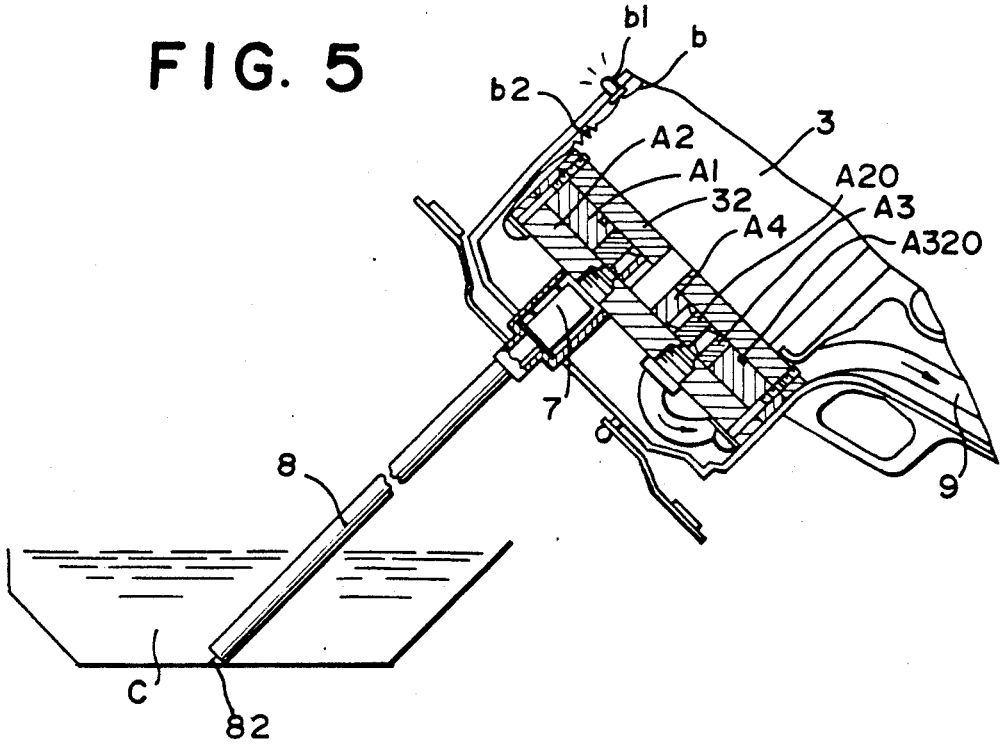

PORTABLE AUTOMOBILE ENGINE OIL SUCTION PUMP

BACKGROUND OF THE INVENTION

This invention relates to an improvement of a portable type of automobile engine oil suction pump, particularly such improvement which enables the users to be aware of the running out of the engine oil by a luminous indication device.

The inventor of this patent case has filed a patent application under the title of "A Portable Automobile Grease Suction Machine" on Apr. 17, 1990 under Ser. No. 07/509,745. This device is illustrated in FIG. 1, wherein it can be seen that the main structure is the body 1 which is formed by mirror-image body shells. The body 1 is similar in shape to a portable type of air dryer, and encloses: a gear pump case which comprises a first portion 40, a middle portion 41 and a second portion 42; a motor 3 with blades 30 which are fixed to a motor shaft; a gear unit 5; a rotating shaft connecting member 6; and an oil suction pipe joint 7. A suction tube 8 and an oil discharge tube 9 are connected to the pipe joint 7 and to the pump discharge. In this invention, the gear pump case 4 is connected with the motor output shaft by means of shaft connecting member 6. The gear unit 5 is located in the interior of the middle portion 41 of the gear pump case, and is operated by means of the connection of the shaft 400 to one of its gears and to the shaft connecting member 6. The oil suction pipe joint 7 is screwed into a threaded suction hole formed on the second portion 42 of the gear pump case. The oil discharge tube 9 is set in oil discharge guiding grooves 13, which are defined in the interior of the shell body and is also connected with the joint 402*a* attached to the pump discharge. In use, after having connected the suction tube 8 with the oil pipe joint 7, the suction pipe 8 is inserted into the engine oil chamber. At the same time, the electric wire is attached to the battery of the motor vehicle, or it is inserted into the cigarette lighter of the motor vehicle by means of a socket terminal. In so doing, the motor 3 will be started by the motor vehicle's battery to drive the gear unit 5, and to prooduce a strong suction force by the movement of the gear unit 5, so as to ultimately achieve the object of sucking the oil from the engine.

SUMMARY OF THE INVENTION

This invention aims at providing a portable type of automobile engine oil suction pump which features a simple construction and a luminous indication lamp to warn its users of the exhaustion of the engine oil.

This invention provides the improved structure of a portable type of automobile engine oil suction pump. Its main features comprise: an inner gear set comprising an inner ring gear and a pinion gear in the interior of two circular disks; and, an eccentric, convex, crescent-shaped block having an inner concave edge in touch with the pinion, and located eccentric to the ring gear with its convex side jointly set with the pinion to form an outer peripheral shape so as to enable one side of the inner ring gear to be engaged by the pinion, and the other side to keep in touch with the convex face of the eccentric crescent block, so as to allow the inner pinion to directly join with the resolving shaft of the motor to cause the ring gear to rotate. This enables a suction force to be formed at an opening at one end of the eccentric crescent block as well as an expulsion force to be formed at its other end. The aforementioned structure will be used as a gear pump case and, at the same time, conductive materials are used for making the joint of the suction tube. A conducting wire extends out of the outer shell of the motor to join with a luminous diode and a resistance, and to further connect with the electric wire of the suction machine. When the socket of the suction pipe is connected to its joint, the steel wire inside the oil suction pipe will be electrically connected with the electric wire of the oil suction pump by means of the contact made between the end of the steel wire and the joint of the oil suction pipe. Therefore, when the oil suction pipe contacts the bottom plate of the engine oil reservoir, it will, by means of such contact enable a luminous diode or an LED circuit system to form a return passage and to further cause the users to be aware of the exhaustion of the engine oil by the illumination of the luminous diode or LED system.

BRIEF DESCRIPTION OF THE DRAWINGS

FIG. 4 is a cross-sectional side view of this invention.

FIG. 5 is a partial side view, partially broken away illustrating the operation of this invention.

DETAILED DESCRIPTION OF THE PREFERRED EMBODIMENT

Figure 1:
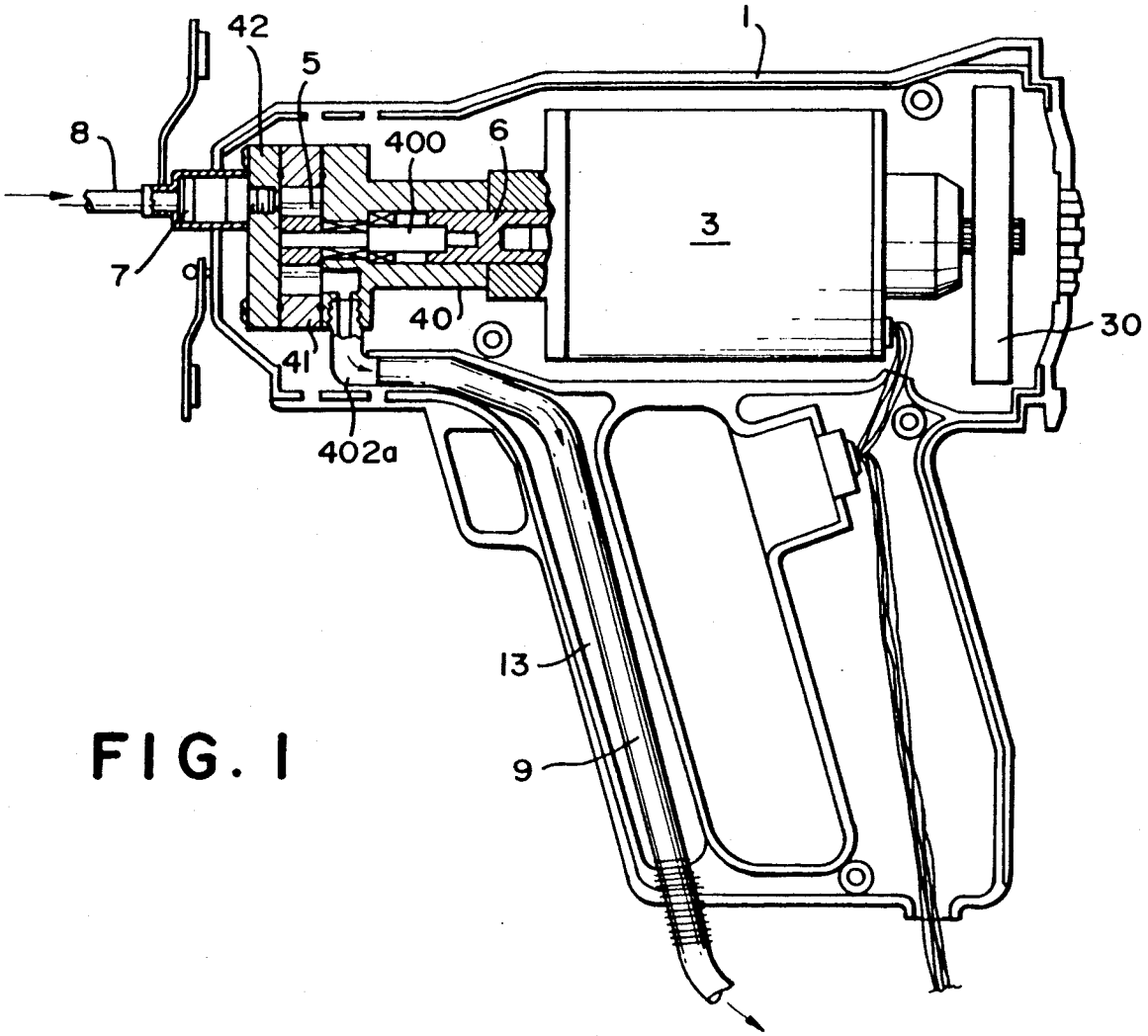
FIG. 1 is cross-sectional view of a previous invention.
Figure 2:
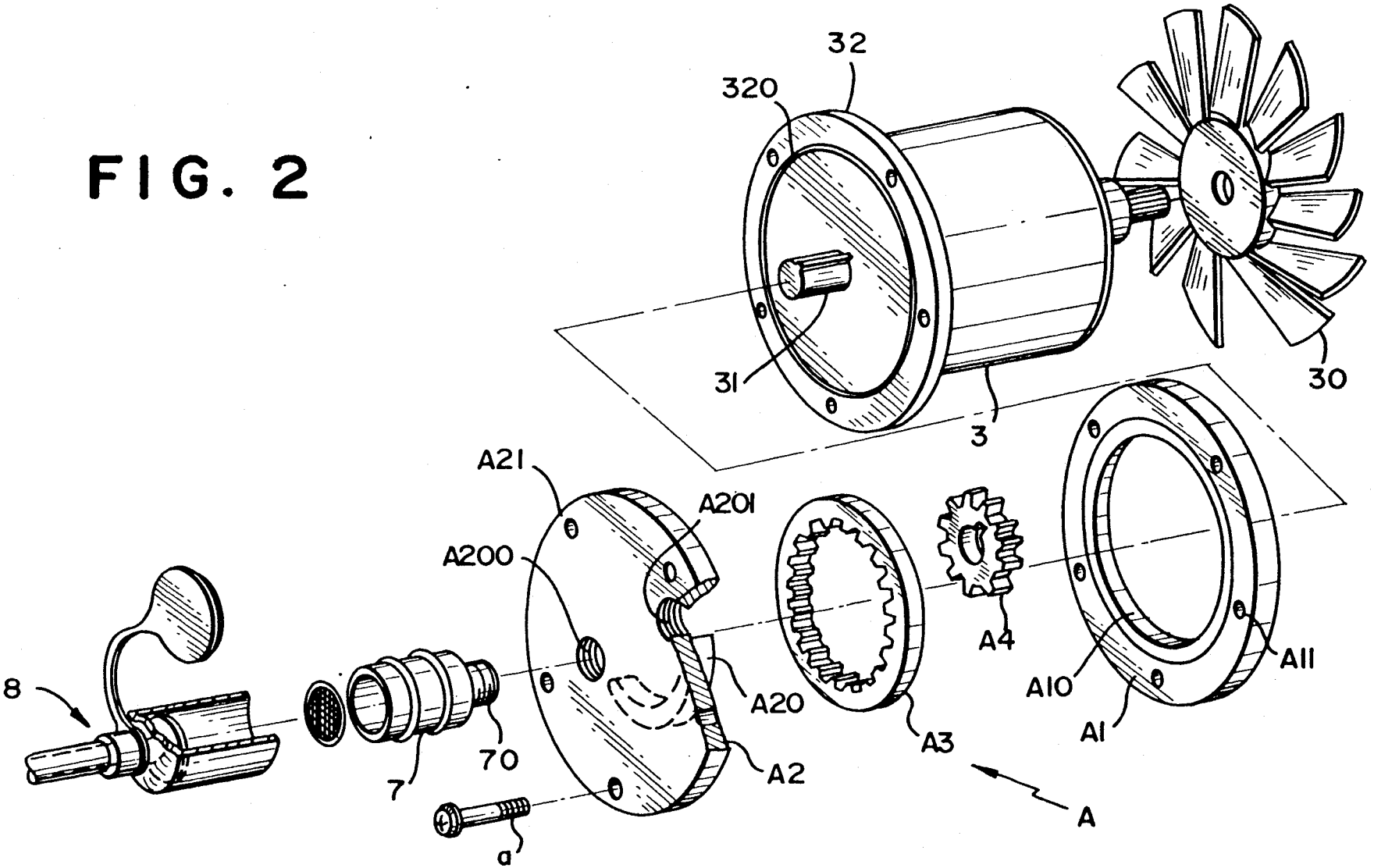
FIG. 2 is an exploded view of the motor and pump structure of this invention.
Figure 3:
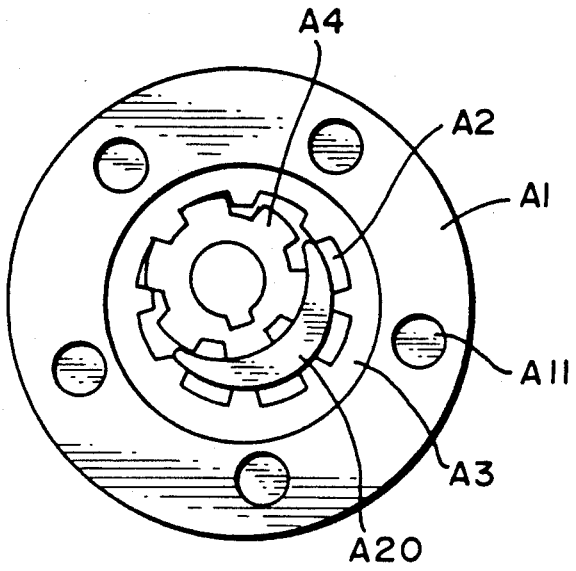
FIG. 3 is an end view of the inner gear pump body of this invention.
Figure 6:
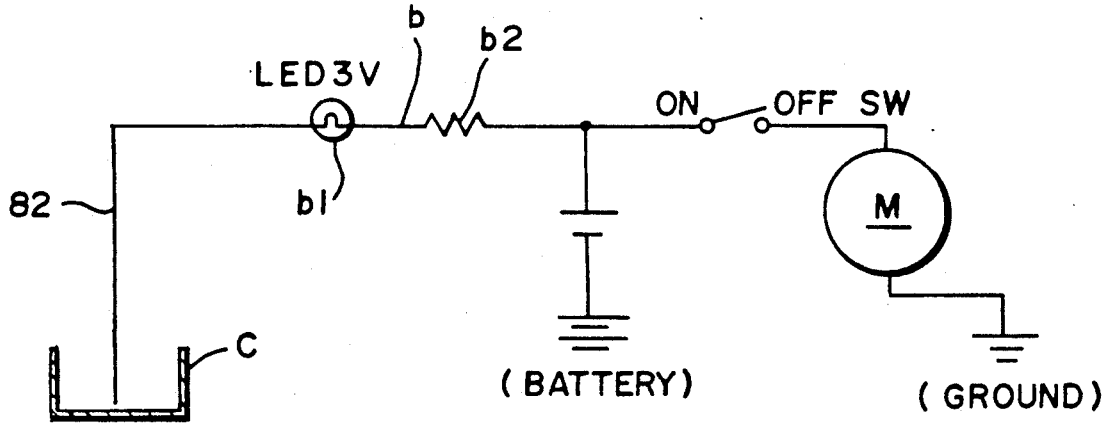
FIG. 6 is a schematic circuit diagram of the visual inducting system according to this invention.

From the illustration made under FIG. 4, it can be seen that similar to the design of our previous application, this invention has shell body 1 which is similar in shape to that of a portable air dryer. The shell body may be formed with opposite halves that are symmetrical with each other. This invention also has a motor 3, an oil suction pipe joint 7, a suction pipe 8, a discharge pipe 9 and associated elements. The location of each of these elements is similar to that of the previously filed patent application case. However, in the present invention, an inner gear assembly body A is used instead of the pump of the previous device. The inner gear assembly body A comprises first and second circular disks A1, A2, an inner ring gear A3 and a pinion gear A4. Each of these elements may be made by power metallurgical techniques. In the center of the first circular disk A1 there is a circular hole A10 which is slightly larger than the exterior diameter of the inner ring gear A3. On the second circular disk A2 there is an eccentric cresent-shaped convex block A20. Also at the extreme ends of the crescent-shaped convex block A20 two threaded screw holes A200 and A201 are located. In order to assemble the device, inner ring gear A3 is placed within the central circular hole A10 of the first circular disk A1. Then, screw holes A11, A21, which are formed on the first and the second circular disks A1, A2 are aligned with each other, so as to enable the first and the second circular disks A1 and A2 to be connected via screws a. At this time, the inner ring gear A3 will slightly contact the external convex peripheral surface of block A20. In the space between the inner concave surface of the crescent shaped convex block A20 and the corresponding inner ring gear A3, the pinion gear A4 is located such that one side of the pinion A4 is engaged with the inner ring gear A3, and its other side contacts the inner concave surface of the block A20. As shown in FIG. 3, by means of connecting the axial hole through the pinion A4 with the dynamic power output shaft 31 of the motor 3, as well as making use of screw bolts a passing through fixing holes A11 and A12, the circular disks A1 and A2 can be firmly attached to the body 32 of the motor 3. Tightly fastened between the circular disk A1 and the body 32 is a leakage preventing rubber ring 320. The dynamic force of the motor 3 drives the inner ring gear A3 through rotation of the pinion gear A4. The same rotation direction will be produced by the pinion gear A4 and the inner ring gear A3. Rotation of the pinion gear A4 and the inner ring gear A3 at high speed will facilitate, at the holes A200 and A201 located at opposite ends of the half moon shaped convex block A20, a suction force and an expulsion force. The action between the teeth of the pinion gear A4 and the inner ring gear A3 sucks the engine oil from the suction hole A200 and passes it through the discharge hole A201 into the discharge tube 9 for discharging. Another feature of this patent application lies in the adoption of a conducting material for the fabrication of the oil suction tube joint 7. At the same time, an electric wire b is extended out of outer shell of the motor, and is connected to a luminous diode or LED b1 and a resistance b2. The electric wire b is further connected to the power wire of the oil suction pump itself. The suction pipe 8 is connected with the suction pipe joint 7. To use the device, the suction pipe 8 is inserted into the automobile engine oil casing. At the same time, the electric supply wire D is clamped to the battery of the motor vehicle or is inserted into the cigarette lighter of the motor vehicle by means of a socket terminal. In this way, by making use of the battery of the motor vehicle itself the motor 3 will be caused to operate so as to drive the pinion gear A4 and the inner ring gear A3 to suck the engine oil from the engine case. As a result of the contact of the steel wire 82 in the suction pipe 8 with the suction pipe joint 7, when the suction pipe 8 is deeply inserted into the bottom of the engine case c, it will, by means of contact between the end of the steel wire 82 and the bottom plate of the engine case c, complete the circuit and enable the luminous diode or the circuit of LED b1 to form a return system as seen in the illustrations in FIGS. 5 and 6. It will be brought to the users attention by the illumination of the diode or the LED b1 that the engine oil is depleted as a result of suction.

I claim:

1. An improved portable type automobile engine oil suction pump having a housing, and an electric motor having an output drive shaft, the motor adapted to be connected to a source of electrical power comprising:

a) an internal gear pump comprising:
   i) a first circular disk defining an opening;
   ii) a second circular disk defining a suction inlet and an outlet;
   iii) a cresent-shaped block protruding from an interior side of the second circular disk and extending generally between the suction inlet and outlet;
   iv) a ring gear rotatably located within the opening defined by the first disk such that it is in contact with a convex surface of the cresent-shaped block;
   v) a pinion gear in driving engagement with the ring gear and located such that it is in contact with a concave surface of the cresent-shaped block; and,
   vi) means to attach the first and second disks to the electric motor such that the output drive shaft drivingly engages the pinion gear;

b) a suction pipe joint formed of electrically conductive material attached to the second disk such that the joint communicates with the suction inlet;

c) a suction tube having an electrically conductive wire extending therethrough attached to the suction pipe joint such that the wire is in electrically conductive contact with the suction pipe joint;

d) a visual light source; and, e) electrical circuit means interconnecting the electric motor, the visual light source and the electrically conductive wire such that contact between the electrically conductive wire and a wall of an oil reservoir will cause the visual light source to be illuminated.

2. The improved portable type automobile engine oil suction pump of claim 1 wherein the visual light source comprises a light emitting diode (LED).

3. The improved portable type automobile engine oil suction pump of claim 1 further comprising discharge pipe operatively connected to the second circular disk such that it communicates with the outlet.

* * * * *